US006302602B1

(12) United States Patent
Kiyohara et al.

(10) Patent No.: US 6,302,602 B1
(45) Date of Patent: Oct. 16, 2001

(54) APPARATUS FOR CUTTING-RECORDING MEDIUM

(75) Inventors: Naoki Kiyohara; Iwao Kawamura; Ryoma Suzuki; Takashi Nakamura; Kensuke Izuma; Kiyokazu Namekata, all of Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/463,721

(22) PCT Filed: Sep. 29, 1998

(86) PCT No.: PCT/JP98/04359

§ 371 Date: Jan. 28, 2000

§ 102(e) Date: Jan. 28, 2000

(87) PCT Pub. No.: WO99/16590

PCT Pub. Date: Aug. 4, 1999

(30) Foreign Application Priority Data

Sep. 30, 1997 (JP) ..... 9-266184

(51) Int. Cl.[7] ..... B41J 11/66

(52) U.S. Cl. ..... 400/593; 400/621; 83/614

(58) Field of Search ..... 400/593, 621; 83/614, 56, 636, 581; 101/226, 227, 93.07

(56) References Cited

U.S. PATENT DOCUMENTS

| | | | | |
|---|---|---|---|---|
| 4,922,774 | * | 5/1990 | Oldeman | 83/175 |
| 4,984,916 | * | 1/1991 | Sekine | 400/613.1 |
| 5,272,947 | * | 12/1993 | Peters | 83/455 |
| 5,307,716 | * | 5/1994 | Onishi | 83/488 |
| 5,882,128 | * | 3/1999 | Hinojosa | 400/593 |
| 5,893,310 | * | 4/1999 | Hirao et al. | 83/278 |

FOREIGN PATENT DOCUMENTS

| | | |
|---|---|---|
| 181396/1987 | 11/1987 | (JP) . |
| 124493/1988 | 8/1988 | (JP) . |

* cited by examiner

*Primary Examiner*—John S. Hilten
*Assistant Examiner*—Kevin D. Williams
(74) *Attorney, Agent, or Firm*—Dellett and Walters

(57) ABSTRACT

The relative positions of cutter blade 42, platen 28, pressing member 44, and bending guide 46 are adjusted to obtain the acute angle Θ between side face 42*a* of cutter blade 42 facing to the delivery direction and recording medium 29 in the range from 25° to 65°.

18 Claims, 12 Drawing Sheets

APPARATUS FOR CUTTING-RECORDING MEDIUM

TECHNICAL FIELD

The present invention relates to a recording medium cutting device which cuts a recording medium in a cross direction during delivery thereof in an image formation apparatus for forming an image on a recording medium like recording paper.

BACKGROUND TECHNIQUE

For an output device for computers and work stations, there are known ink-jet type image formation devices which form an image by ejecting ink onto a recording medium such as recording paper, and electrophotography type image formation devices which form an image with toner. Some of the image formation apparatuses are provided with a recording medium cutting device for cutting the delivered recording medium in a cross direction (direction of breadth of the recording medium).

The recording medium cutting device has a cutter blade which cuts the delivered and stopped recording medium by moving in the breadth direction of the medium. The cutter blade, which may be in a knife shape or a disk shape, moves in a straight line to cut the recording medium. The cutter blade moves in contact perpendicularly with the horizontally held recording medium.

In cutting of the recording medium as above, at the start of the cutting with the cutter blade by contact of the cutter blade with the edge of the recording medium, the edge of the recording medium can be distorted by resistance against the cutter blade. Such distortion of the edge of the recording medium can retard the penetration of the cutter blade into the recording medium to prevent straight cutting to make the cut edge wind. Such a phenomenon is more liable to occur with a knife type cutter blade than with a disk type cutter blade.

DISCLOSURE OF THE INVENTION

The present invention intends to provide a recording medium cutting device which is improved in the penetration ability of the cutter blade into a recording medium.

To achieve the above object, the recording medium cutting device of the present invention is equipped in a image formation apparatus for forming an image on a recording medium having delivered to an image formation region, and cuts the delivered recording medium, the recording medium cutting device comprising (1) a cutter blade which cuts the delivered recording medium by moving in a direction crossing the delivery direction of the recording medium, (2) with the side face of the cutter blade facing to the delivery direction, being set at an acute angle of not more than 90° to the recording medium.

In the present invention, (3) the acute angle ranges preferably from 25° to 65°, (4) the smaller angle ranges more preferably from 35° to 55°, and (5) the smaller angle ranges still more preferably from 40° to 50°.

BEST MODE FOR CARRYING OUT THE INVENTION

The embodiment of the recording medium cutting device of the present invention is described below by reference to drawings.

Figure 1:
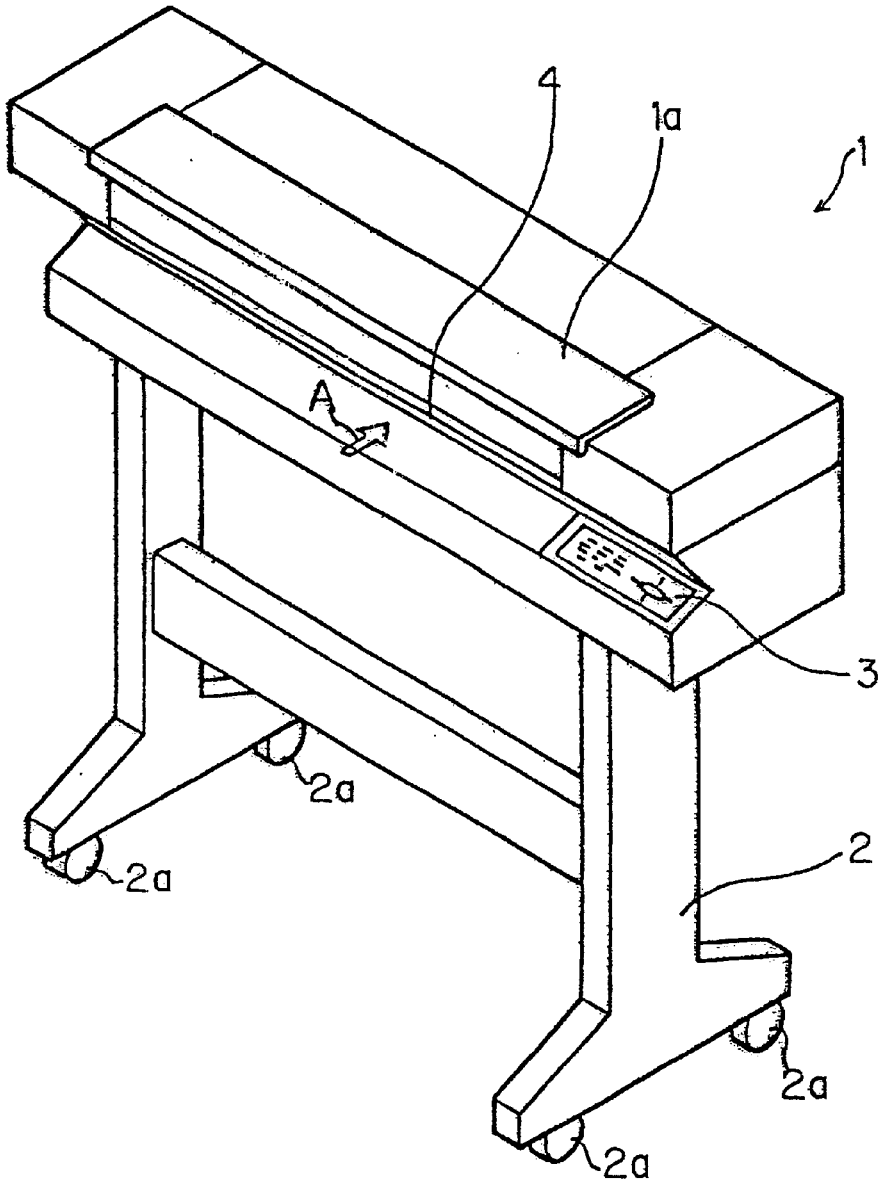
FIG. 1 is a schematic perspective view illustrating a color plotter, an example of the image formation apparatus of the present invention.

FIG. 1 is a schematic perspective view illustrating a color plotter, an example of the ink-jet type image formation apparatus provided with the recording medium cutting device of an embodiment of the present invention (hereinafter the "color plotter" is referred simply to a "plotter").

Plotter 1 is fixed on the top of stand 2 having casters 2*a*. Plotter 1 has operation board 3 for operation thereof. The operation board 3 selects, with the switches, the paper size, on-line/off-line, commands, and so forth. A recording paper sheet (an example of the recording medium) inserted from recording paper inlet 4 is delivered into plotter 1, printed in color, and discharged under the instructions from operation board 3.

The delivery path of the recording paper and the process of the printing (image formation) are described by reference to FIG. 2.

Figure 2:
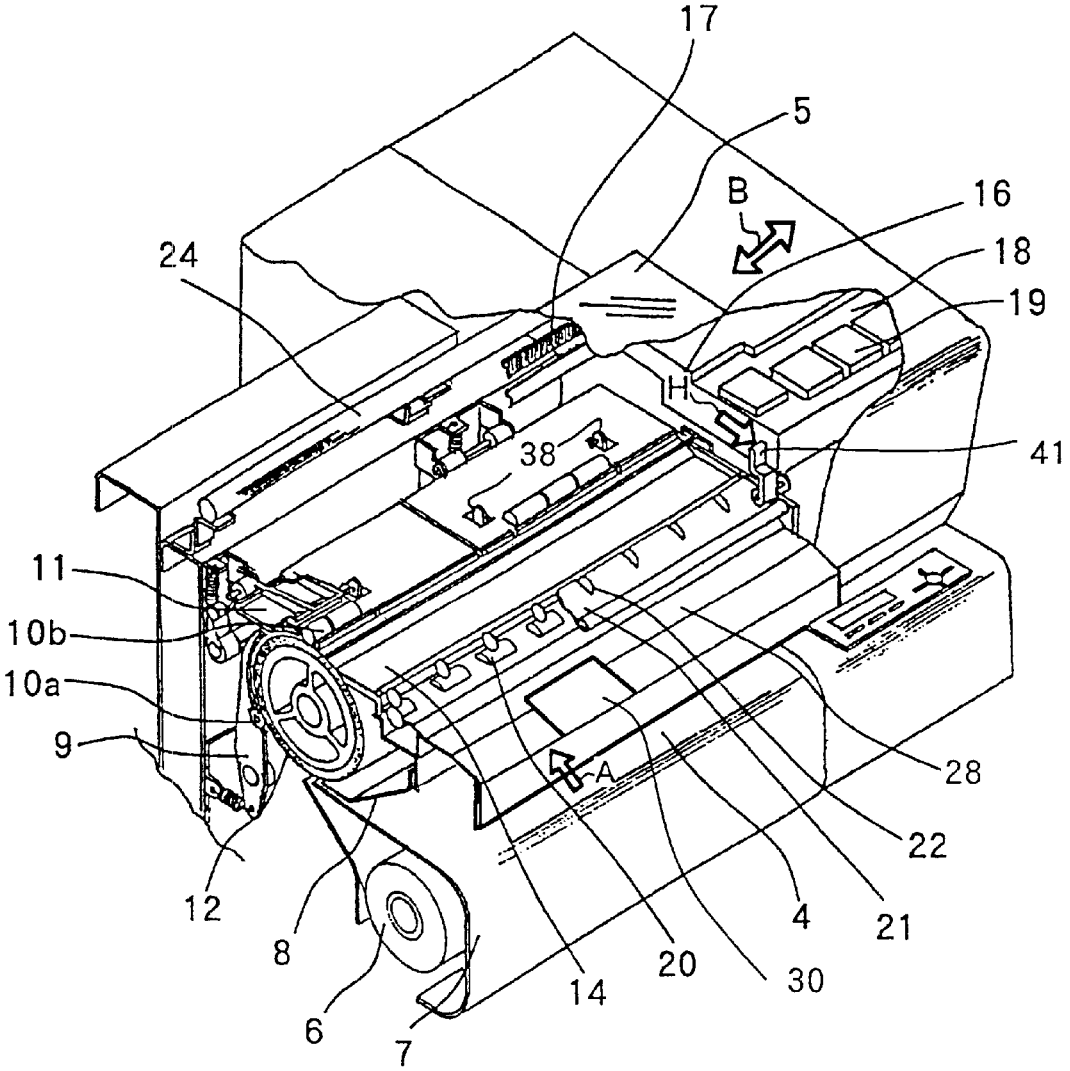
FIG. 2 is a partially cut away view of the color plotter of FIG. 1, illustrating the path of the recording paper sheet from insertion to discharge.

FIG. 2 is a partially cutaway view of the plotter of FIG. 1, illustrating the path of the recording paper sheet from insertion to discharge.

Plotter 1 conducts printing either on a recording paper sheet inserted through recording paper sheet inlet 4 or rolled recording paper (roll paper 6). The delivery path is described here for the recording paper sheet inserted through recording paper sheet inlet 4. However, the roll paper 6 can be delivered in a similar manner.

Recording paper (e.g., a cut paper sheet of a large size) is placed in a prescribed position on cover 7 of roll paper 6, and is inserted in the arrow A direction into recording paper inlet 4. The inserted recording paper is delivered through the gap between cover 7 and guide 8 onto printing plate 14 (an example of the image formation region in the present invention) by means of paper delivery roller 10*a* fixed rotatably on lower delivery roller supporting plate 9, paper delivery roller 10*b* fixed rotatably on upper delivery roller supporting plate 11, and driving roller 12. The recording paper sheet having passed the printing plate 14 is discharged by discharge roller 20 and spurs 22 above. Spurs 22 are fixed rotatably to spur plate 21.

Plotter 1 is equipped with carriage 16 reciprocating in the arrow B direction. This carriage 16 has head holder 18. This head holder 18 holds plural printing heads 19 respectively containing therein a color ink (e.g., cyan, magenta, yellow, and black colors). Carriage 16 is fastened to belt 17 which is engaged with a carriage driving motor (not shown in the drawing), so that the belt 17 reciprocates in the arrow B direction in accordance with the rotation direction of the carriage driving motor. With the reciprocation movement of belt 17 in the arrow B direction, carriage 16 reciprocates in the arrow B direction along guide rail 24. Recording medium cutting device 30 mentioned later (see FIG. 3) is provided on the downstream side of the image formation region in the recording medium delivery direction (perpendicular to the arrow B direction: an example of the direction of recording medium delivery in the present invention).

The recording paper is delivered intermittently in the direction perpendicular to the arrow B direction. For image formation, the delivery of the recording paper is stopped temporarily, and an ink is ejected from printing heads 19 onto portions of the image formation region of the recording paper by reciprocating movement of carriage 16 in the arrow B direction. Then, the recording paper is delivered by a prescribed distance, and the next band of the image is formed on the adjacent portion of the image formation region. This operation is repeated for the entire length of the recording paper sheet to form a color image on the recording paper. The recording paper carrying the formed image thereon is held between discharge roller 20 and spurs 22 and is discharged along platen (discharge guide) 28.

Figure 3:
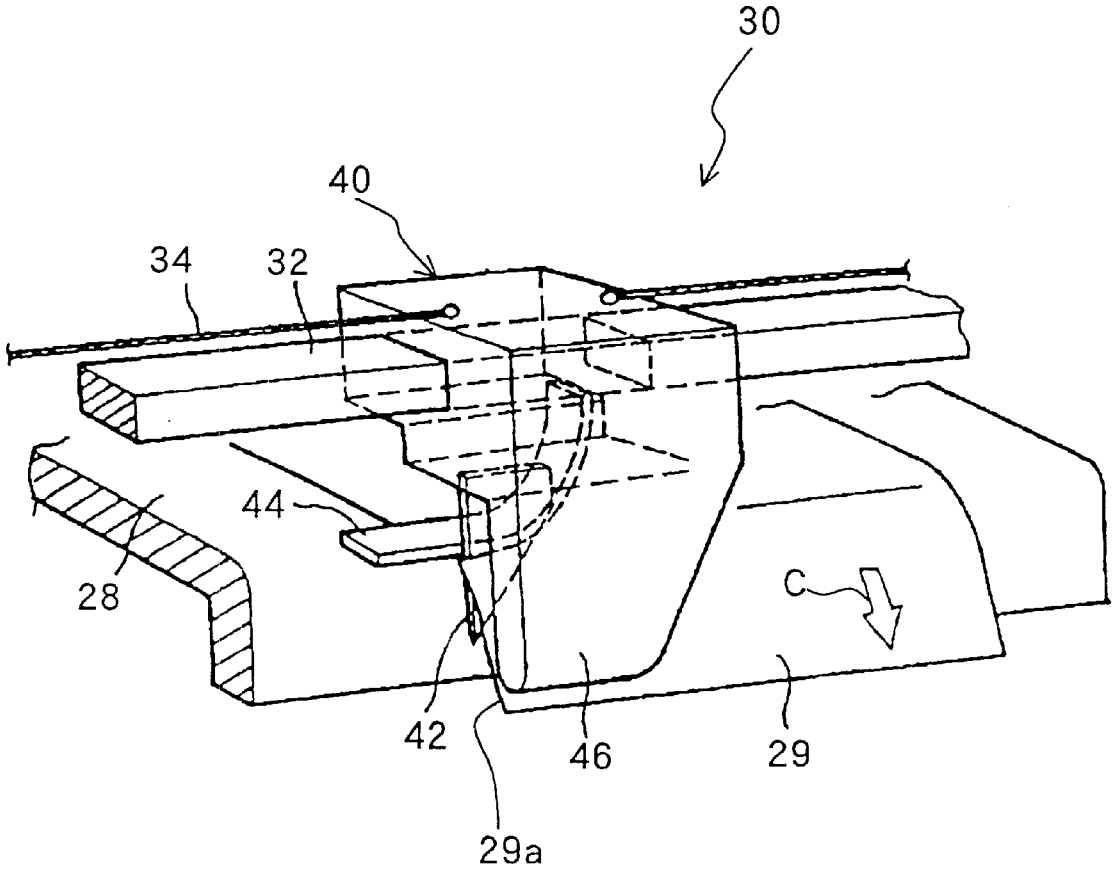
FIG. 3 is a perspective view illustrating an embodiment of the recording medium cutting device of the present invention.
Figure 4:
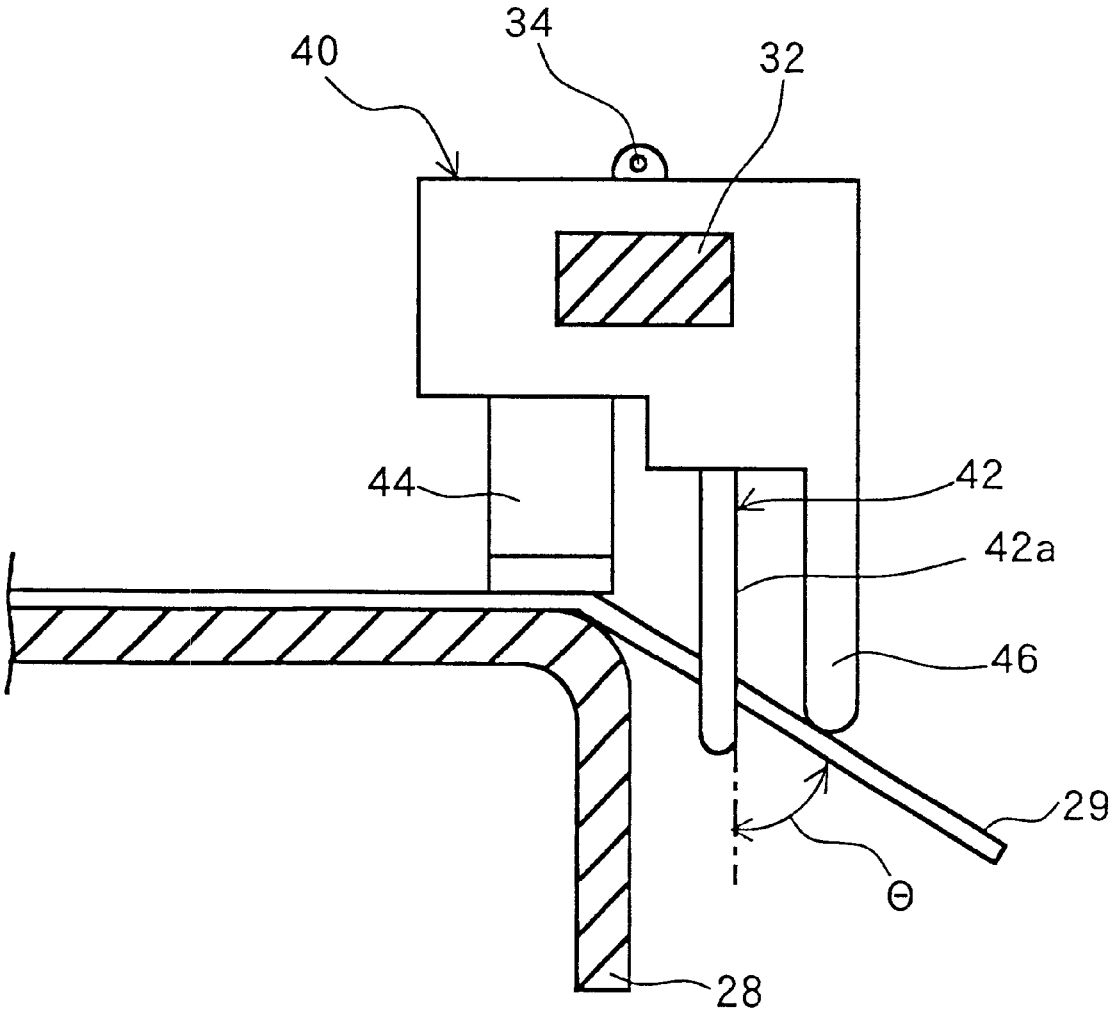
FIG. 4 is a side view illustrating the relative positions of the cutter blade and the recording medium in the recording medium cutting device of FIG. 3.

An embodiment of the recording medium cutting device is explained by reference to FIGS. 3–4. FIG. 3 is a perspective view of the recording medium cutting device. FIG. 4 is a side view illustrating the relative positions of the cuter blade and the recording paper.

As described above, recording medium cutting device 30 is placed on the downstream side of the image formation region in the recording medium delivery direction. In this embodiment, it is placed on the downstream side of discharge roller 20 and spurs 22 (see FIG. 2).

Recording paper 29 with an image formed thereon is delivered along platen 28 in the arrow C direction. Above platen 28, guide rail 32 is provided which extends in a direction perpendicular to the delivery direction (arrow C direction) of recording paper 29. Cutter unit 40 of recording medium cutting device 30 is guided to travel in the direction perpendicular to the delivery direction of recording paper 29 (breadth direction of recording paper 29). Cutter unit 40 is fastened to wire 34 stretched nearly parallel to guide rail 32. Cutter unit 40 is driven by winding and unwinding the wire 34 by a driving motor (not shown in the drawing) along guide rail 32 to reciprocate in the direction of the breadth of recording paper 29.

Cutter unit 40 has cutter blade 42 for cutting recording paper 29 and pressing member 44 for pressing down recording paper 29. During cutting of recording paper 29 with cutter blade 42, pressing member 44 presses down recording paper 29 near cutter blade 42 to fix recording paper 29 at a prescribed position.

Cutter unit 40 has a bending guide 46 extending downward on the side of cutterblade 42 opposite to pressing member 44. This bending guide 46 pushes down recording paper 29 to guide it slantingly downward. During cutting of recording paper 29, recording paper 29 is held at a portion near cutter blade 42 between platen 28 and pressing member 44, and is guided to bending guide 46. As the result, the portion of recording paper 29 near cutter 42 is guided incessantly to the prescribed position.

The relative positions of cutter blades 42, platen 28, pressing member 44, and bending guide 46 are adjusted such that recording paper 29 is guided to the aforementioned prescribed position at an acute angle Θ, relative to side face 42*a* of cutter blade 42 facing to the delivery direction, ranging from 25° to 65°.

At the angle Θ of 90°, as described later by reference to FIGS. 10–13, edge 29*a* of recording paper 29 can be distorted by resistance against cutter blade 42 at the start of cutting of recording paper 29 upon contact of cutter blade 42 with edge 29*a* of recording paper 29, retarding the penetration of cutter blade 42 into recording paper 29. The decrease of the penetration ability of cutter blade 42 may prevent the straight cutting of recording paper 29, or may impair the sharpness of cutting, tending to cause remarkable waving of recording paper 29.

At the aforementioned acute angle Θ of less than 90° at the start of cutting at least, the penetration and the cutting sharpness of cutter blade 42 are improved. At the acute angle Θ of not less than 25° but not more than 65°, the penetration and the cutting sharpness are improved more. Further, at the acute angle Θ of not less than 35° but not more than 55°, the penetration and the cutting sharpness of cutter blade 42 are improved still more. Furthermore, at the acute angle Θ of not less than 40° but not more than 50°, the penetration and the cutting sharpness of cutter blade 42 are improved still more.

In the above embodiment, cutter unit 40 is constituted independently. However, cutter unit 40 may be mounted on carriage 16 (see FIG. 2) to be driven together with this carriage 16. In the above embodiment, cutter blade 42 is held nearly vertically, and recording paper 29 is guided slantingly downward by pushing recording paper 29 down with bending guide 46 to adjust the acute angle Θ to be in the range from 25° to 65°. However, recording paper 29 may be held unbendingly with cutter blade 42 tilted as shown later in FIG. 9.

A second embodiment of the recording medium cutting device is explained below by reference to FIG. 5.

Figure 5:
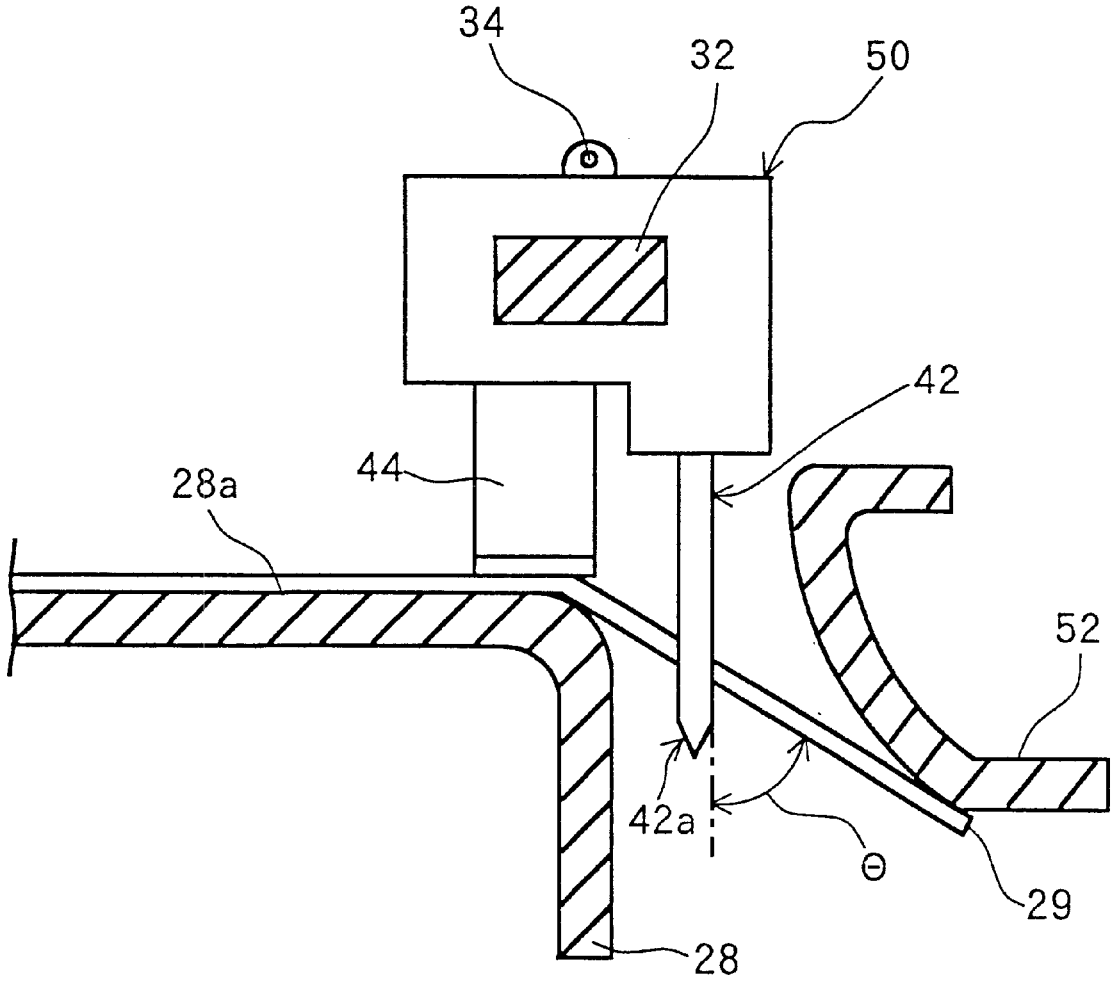
FIG. 5 is a side view illustrating the relative positions of the cutter blade and the recording medium in Embodiment 2 of the recording medium cutting device of the present invention.

FIG. 5 is a side view illustrating the relative positions of the cutter blade and the recording paper. In FIG. 5, the same symbols are used to indicate the corresponding constitutional elements as in FIGS. 3–4.

The cutter unit 50 in the second embodiment does not have bending guide 46 shown in FIG. 4. However, instead of bending guide 46, guide 52 having a sectional shape nearly of an alphabet "C" is provided at a position lower than upper face 28*a* of platen 28. Recording paper 29 sent out from platen 28 is guided downward by guide 52. This guide is designed such that the portion of recording paper 29 guided downward forms an angle Θ ranging from 25° to 65° to side face 42*a* of cutter 42. The portion having been guided downward is cut by cutter blade 42.

A third embodiment of the recording medium cutting device is explained below by reference to FIG. 6.

Figure 6:
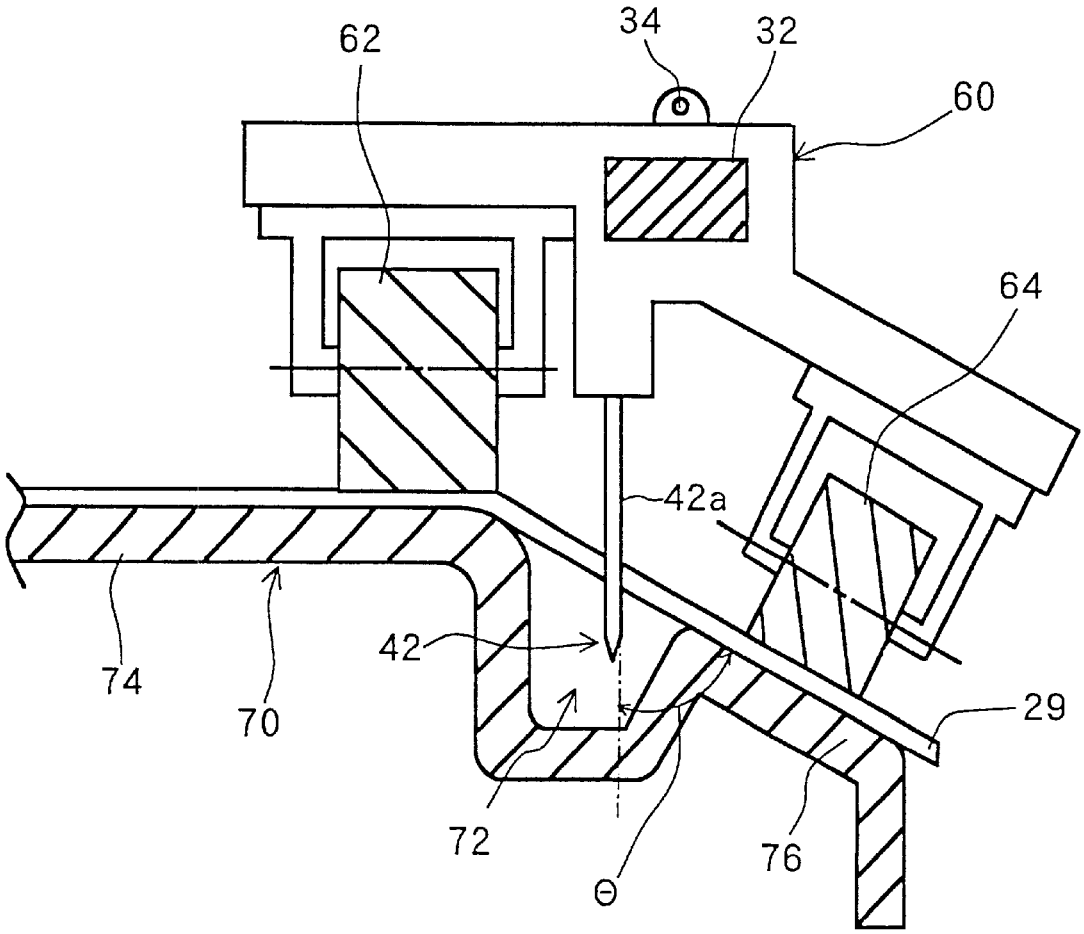
FIG. 6 is a side view illustrating the relative positions of the cutter blade and the recording medium in Embodiment 3 of the recording medium cutting device of the present invention.

FIG. 6 is a side view illustrating the relative positions of the cutter blade and the recording paper. In FIG. 6, the same symbols are used to indicate the corresponding constitutional elements as in FIGS. 3–4.

In cutter unit 60 of the third embodiment, recording medium pressing roller 62 is provided to press recording paper 29 on the upstream side of cutter blade 42 in the delivery direction. Another recording medium pressing roller 64 is provided on the downstream side of cutter blade 42 in the delivery direction. Platen 70 has groove 72 for accepting the tip of cutter blade 42 for cutter movement. Recording paper 29 is held between portion 74 of platen 70 on the upstream side of groove 72 and recording paper pressing roller 62. Portion 76 of platen 70 on the downstream side of groove 72 is positioned lower than upstream side portion 74. Recording paper 29 is held between this downstream portion 76 and recording paper pressing roller 64.

Downstream portion 76 of platen 70 is placed lower than upstream portion 74 to obtain the angle Θ between the portion of recording paper 29 above groove 72 and side face 42*a* of cuter blade 42 to be not less than 25° but not more than 65°. Recording paper 29 is cut at the portion above groove 72 by cutter blade 42.

A fourth embodiment of the recording medium cutting device is explained below by reference to FIG. 7.

Figure 7:
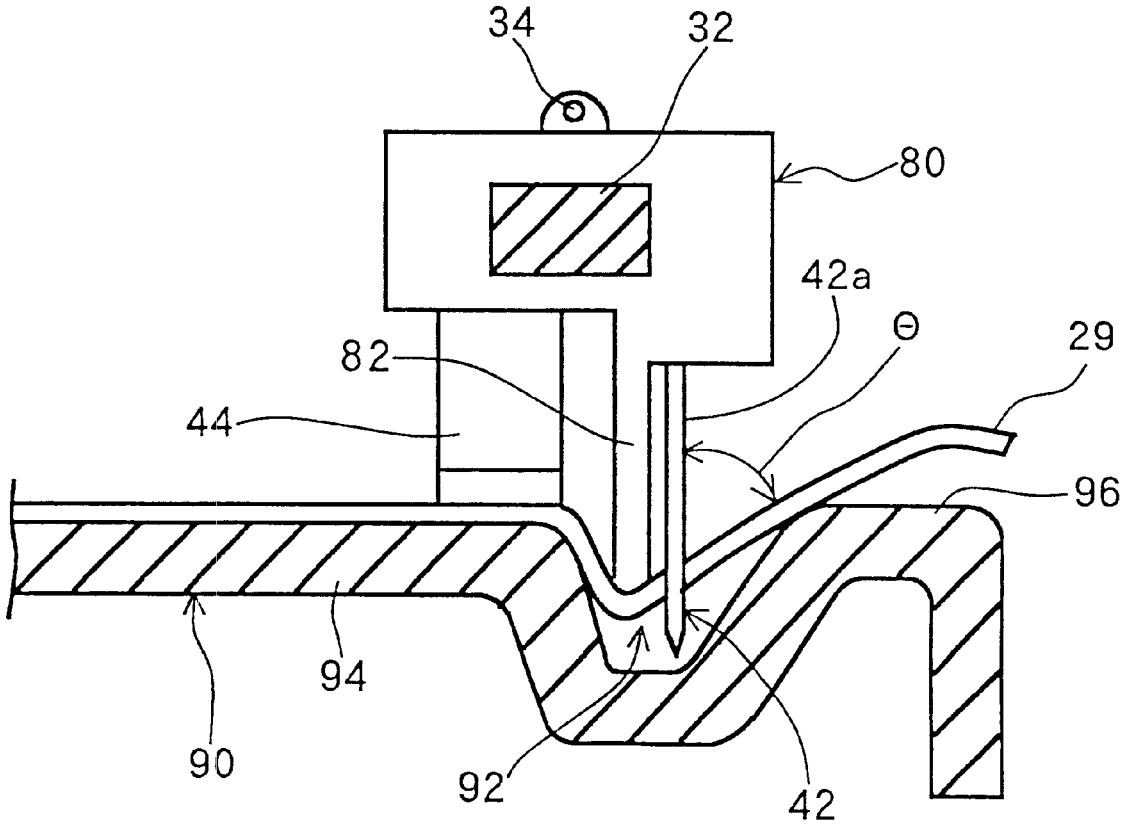
FIG. 7 is a side view illustrating the relative positions of the cutter blade and the recording medium in Embodiment 4 of the recording medium cutting device of the present invention.

FIG. 7 is a side view illustrating the relative positions of the cutter blade and the recording paper.

In FIG. 7, the same symbols are used to indicate the corresponding constitutional elements as in FIGS. 3–4.

In cutter unit 80 of the fourth embodiment, recording medium pressing member 82 is provided to press recording paper 29 on the upstream side of cutter blade 42 in the delivery direction. Platen 90 has groove 92 for accepting the tip of cutter blade 42 for cutter movement. Recording paper 29 is held between portion 94 of platen 90 on the upstream side of groove 92 and pressing member 44. Portion 96 of platen 90 on the downstream side of groove 92 is on nearly the same level as upstream side portion 94.

Recording paper 29 is pressed at the portion above groove 92 by recording medium pressing member 82 to make the angle Θ between this portion of recording paper 29 and side face 42*a* of cutter blade 42 to be not less than 25° but not more than 65°. Recording paper 29 is cut at the portion above groove 92 by cutter blade 42.

A fifth embodiment of the recording medium cutting device is explained below by reference to FIG. 8.

Figure 8:
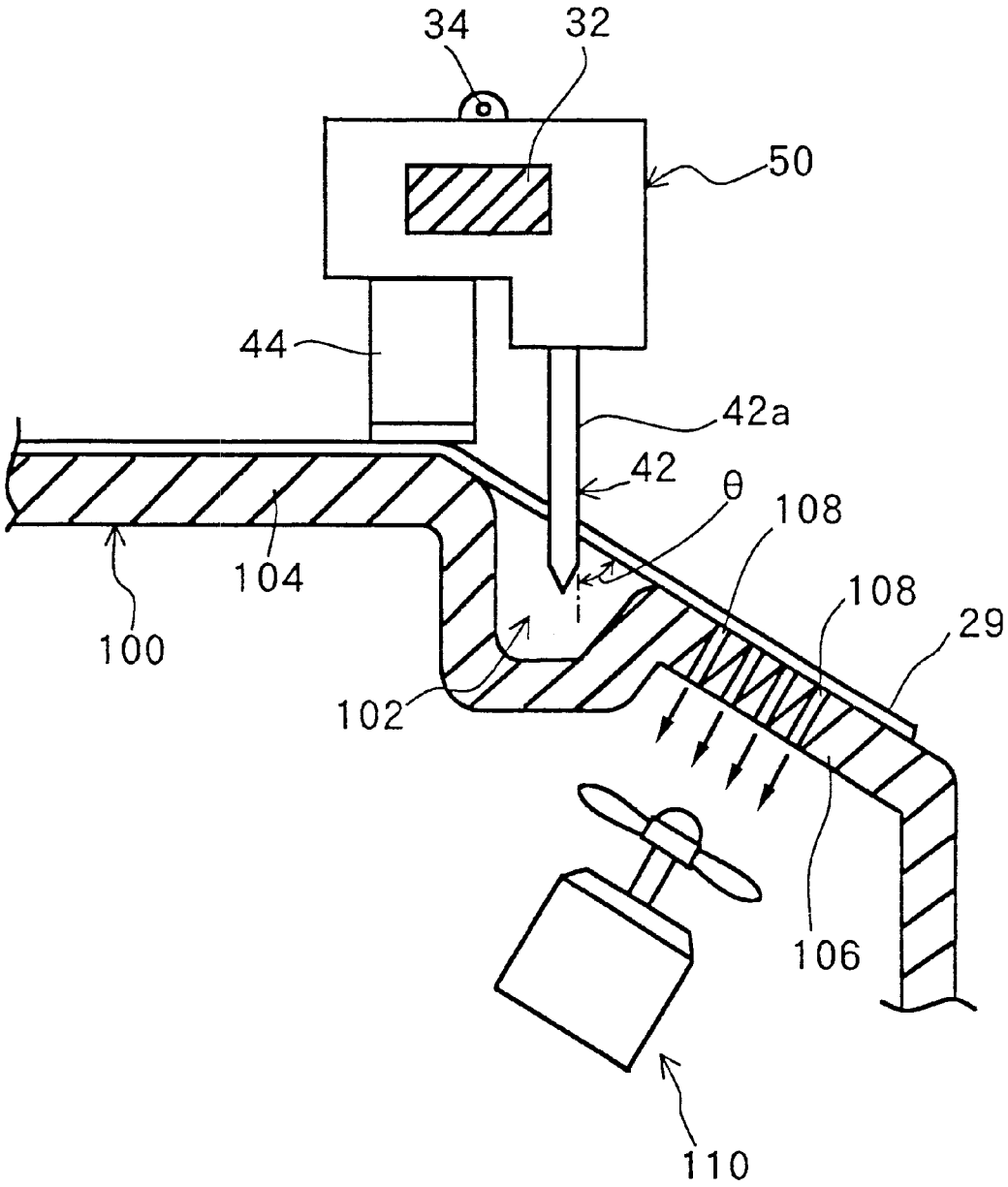
FIG. 8 is a side view illustrating the relative positions of the cutter blade and the recording medium in Embodiment 5 of the recording medium cutting device of the present invention.

FIG. 8 is a side view illustrating the relative positions of the cutter blade and the recording paper.

In FIG. 8, the same symbols are used to indicate the corresponding constitutional elements as in FIGS. 3–4.

Cutter unit 50 of the fifth embodiment has the same constitution as the cutter unit 50 in FIG. 5. This fifth embodiment is characterized by platen 100. Platen 100 has groove 102 for accepting the tip of cutter blade 42 for cutter movement. Recording paper 29 is held between portion 104 of platen 100 on the upstream side of groove 102 and recording paper pressing member 44. Portion 106 of platen 100 on the downstream side of groove 102 is placed lower than upstream portion 104. This downstream portion 106 has many suction holes 108. Inside this downstream portion 106 of platen 100, fan 110 is provided to suck recording paper 29 passing along suction holes 108 to attach it closely to downstream portion 106.

As described above, downstream portion 106 of platen 100 is placed on a level lower than upstream portion 104, and recording paper 29 is attached closely to downstream portion 106 to obtain the angle Θ between the portion of recording paper 29 above groove 102 and side face 42*a* of cutter blade 42 to be not less than 25° but not more than 65°. Recording paper 29 is cut at the portion above groove 102 by cutter blade 42.

A sixth embodiment of the recording medium cutting device is explained below by reference to FIG. 9.

Figure 9:
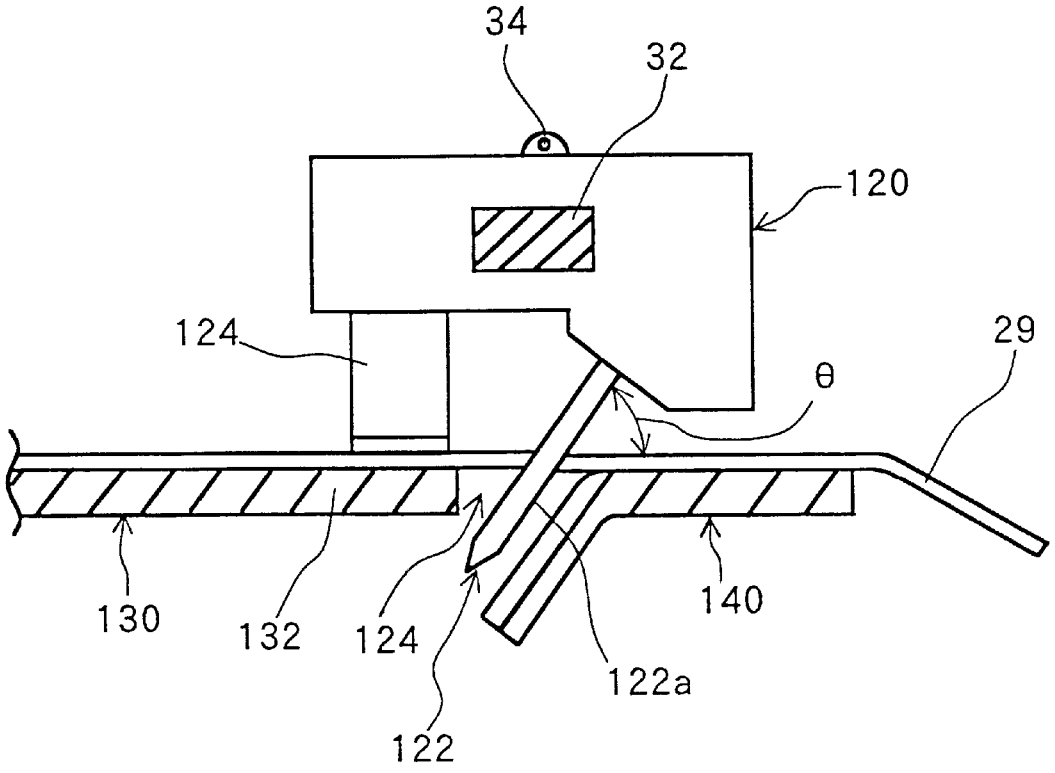
FIG. 9 is a side view illustrating the relative positions of the cutter blade and the recording medium in Embodiment 6 of the recording medium cutting device of the present invention.

FIG. 9 is a side view illustrating the relative positions of the cutter blade and the recording paper.

In FIG. 9, the same symbols are used to indicate the corresponding constitutional elements as in FIGS. 3–4.

In cutter unit 120 of the sixth embodiment, recording medium pressing member 124 is provided to press recording paper 29 on the upstream side of cutter blade 122 in the recording medium delivery direction. A portion of platen 130 near recording medium pressing member 124 is made flat. Recording paper 29 is held between this flat portion 132 and recording member pressing member 124. Guide plate 140 is provided in front of flat portion 132 of platen 130. Between flat portion 132 of platen 130 and guide plate 140, slit 124 is formed for movement of cutter 122. Recording paper 29 passing over flat portion 132 of platen 130 is delivered on the same plane over slit 124 to guide plate 140.

Cutter blade 122 is set to be slant to the portion of recording paper 29 passing over slit 124. The slant angle Θ, namely the angle between the portion of recording paper 29 passing over slit 124 and side face 122*a* of cutter blade 122, is designed to be not less than 25° but not more than 65°. Recording paper 29 is cut at the portion passing over slit 124 by cutter blade 122.

Experimental results obtained by changing the aforementioned angle Θ are explained by reference to FIGS. 10–13.

Figure 10:
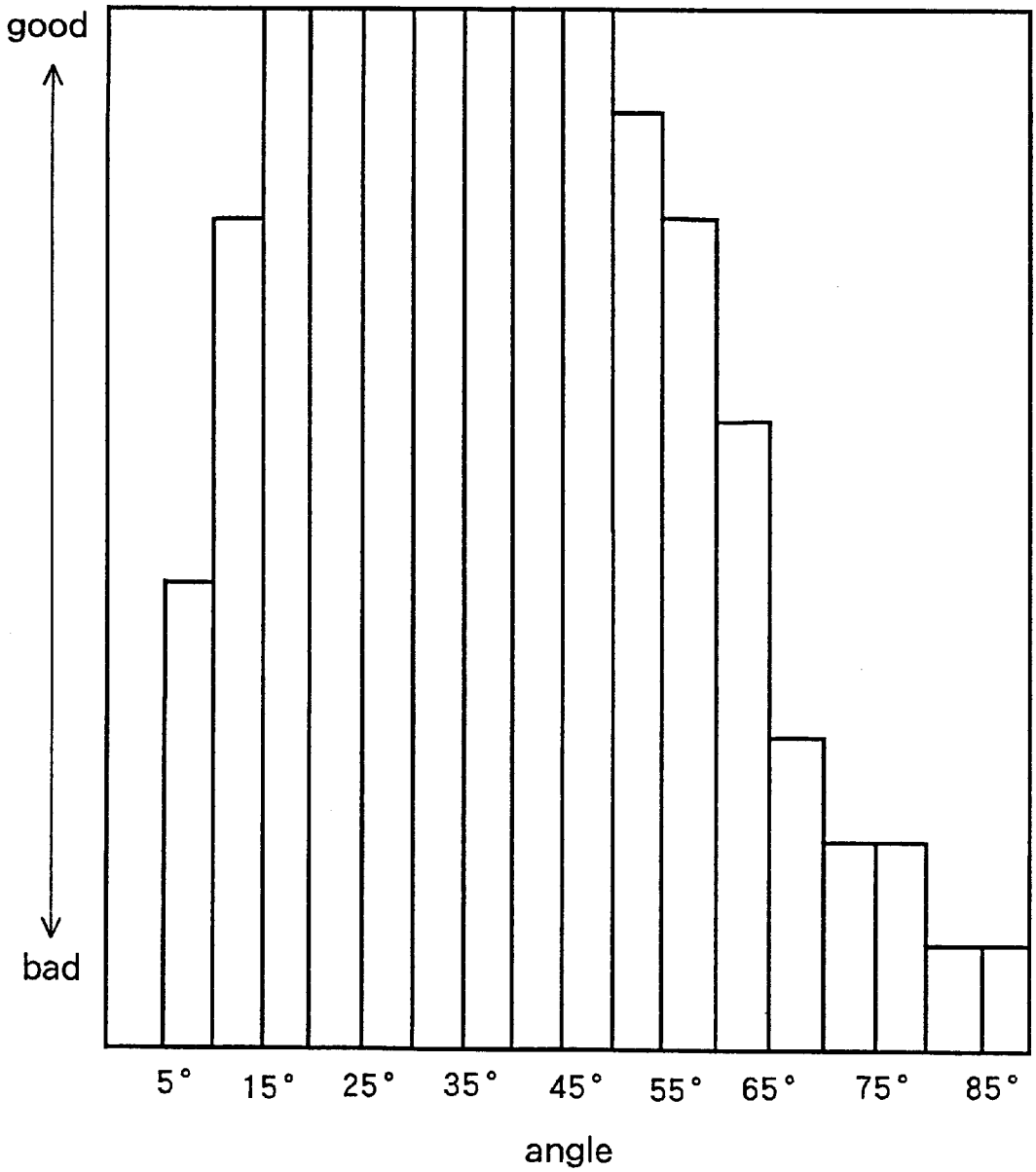
FIG. 10 is a graph showing the dependence of the penetration on the angle Θ.
Figure 11:
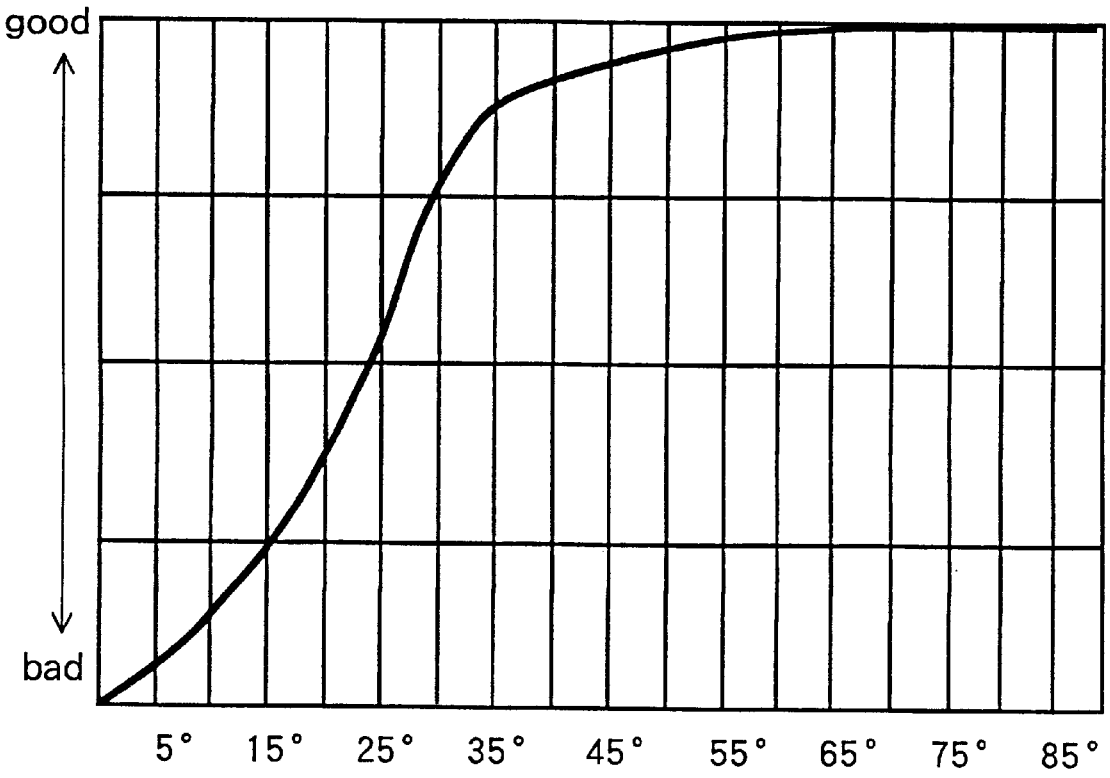
FIG. 11 is a graph showing the dependence of the straightness of the cutting on the angle Θ.
Figure 12:
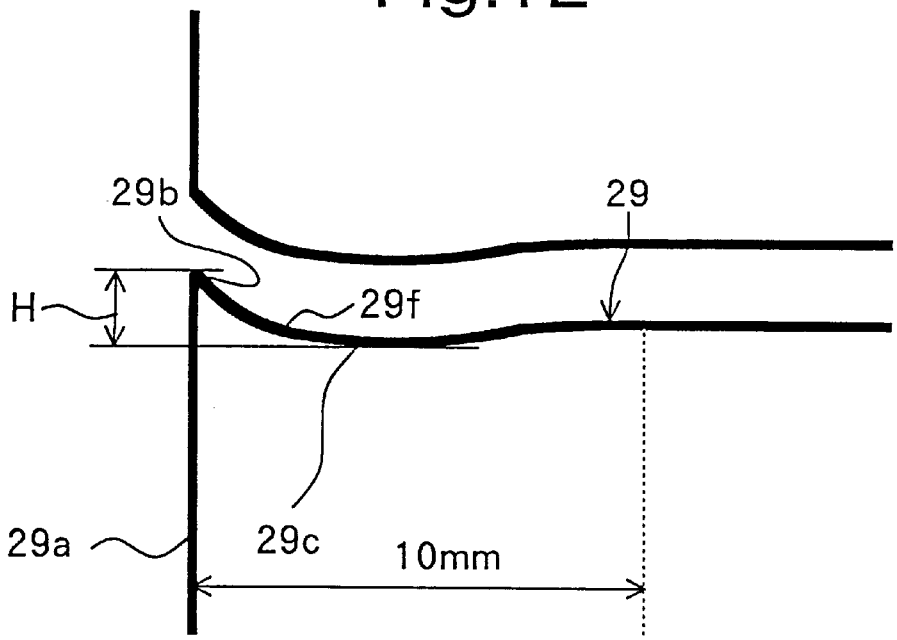
FIG. 12 shows the criterion of evaluation of the penetration ability.
Figure 13:
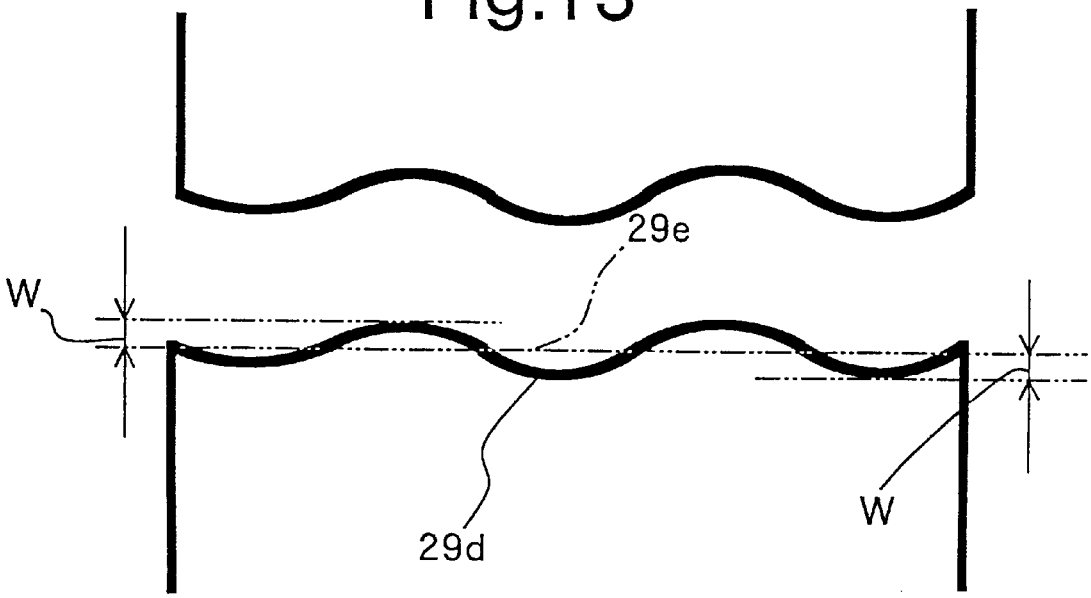
FIG. 13 shows the criterion of evaluation of the straightness of the cutting.

FIG. 10 is a graph showing the dependence of the penetration on the angle Θ. FIG. 11 is a graph showing the dependence of the cutting straightness on the angle Θ. FIG. 12 shows the criterion of the penetration being evaluated. FIG. 13 shows the criterion of the cutting straightness being evaluated.

In FIG. 10, the ordinate represents the relative penetration ability, showing the ratio of ones of high penetration at the respective angles Θ. The abscissa represents the angle Θ.

As shown in FIG. 10, the penetration and cutting sharpness of cutter blade 42, 122 are higher at the angle Θ ranging from 10° to 65° than at the angle Θ of less than 10°, or more than 65°. The penetration and cutting sharpness of the cutter blade 42, 122 are improved more at the angle ranging from 15° to 50°.

The penetration is evaluated, as shown in FIG. 12, by curvature of cut start portion 29*f* of 10 mm long from the cut start edge of recording paper 29 by contact of cutter blade 42, 122 with the edge 29*a* of recording paper 29. The penetration is evaluated to be poor when the difference H between curvature top 29*b* and curvature bottom 29*c* in cut portion 29*f* is 0.5 mm or more. In FIG. 11, the ordinate of the graph represents the straightness of cut edge, showing the ratio of ones of high penetration ability in experiment at the respective angles Θ. The abscissa represents the angle Θ. As shown in FIG. 11, the angle Θ is preferably not less than 25°, more preferably not less than 35°.

The straightness of cut edge is evaluated , as shown in FIG. 13, by the extent of wind at the cut edge 29*d* of recording paper 29 cut by cutter blade 42, 122. The straightness of cut edge is evaluated to be good when the wind extent W is less than 1.0 mm as measured from center line 29*e*, whereas the straightness of cut edge is evaluated to be poor when the wind extent W is larger than 1.0 mm.

As described above, in consideration of the penetration of cutter blade 42,122, and the straightness of cut edge, the angle Θ should be less than 90° at least at the start of cutting. The angle Θ is in the range preferably from 25° to 65°, more preferably from 35° to 55°, still more preferably from 40° to 50°.

INDUSTRIAL AVAILABILITY

As described above, the recording medium cutting device of the present invention comprises a cutter blade which cuts the delivered recording medium by moving in a direction of crossing the delivery direction of the recording medium, and the side face of the cutter blade is placed at an acute angle of not more than 90° to the recording medium. Thereby, the penetration of the cutter blade into the recording medium is improved. The penetration ability of the cutter blade and the cutting straightness are improved more with the acute angle ranging from 25° to 65°.

The penetration ability and the cutting straightness are improved more with the acute angle ranging from 35° to 55°.

The penetration ability and the cutting straightness are improved still more with the acute angle ranging from 40° to 50°.

What is claimed is:

1. A recording medium cutting device for cutting a recording medium, equipped in an image formation apparatus for forming an image on a recording medium having been delivered to an image formation region in a delivery direction, the recording medium cutting device comprising:

a pressing member movably adapted to press against the recording medium for holding the recording medium in a position during a cutting operation, a cutter blade which cuts the recording medium by moving in a direction crossing the delivery direction of the recording medium, said cutter blade having a side face facing to the delivery direction, said side face of the cutter blade facing the delivery direction at an acute angle of less than 90° with respect to the recording medium at a start of cutting, said cutter blade being substantially free of engagement with another surface other than the recording medium during cutting.

2. The recording medium cutting device according to claim 1, wherein the acute angle ranges from 25° to 65°.

3. The recording medium cutting device according to claim 1, wherein the acute angle ranges from 35° to 55°.

4. The recording medium cutting device according to claim 1, wherein the acute angle ranges from 40° to 50°.

5. A recording medium cutting device for cutting a recording medium, equipped in an image formation apparatus for forming an image on a recording medium having been delivered to an image formation region in a delivery direction, the recording medium cutting device comprising:

a pressing member movably adapted to press against the recording medium for holding the recording medium in a position during a cutting operation, a cutter blade which cuts the recording medium by moving in a direction crossing the delivery direction of the recording medium, said cutter blade having a side face facing to the delivery direction, said side face of the cutter blade facing the delivery direction at an acute angle of less than 90° with respect to the recording medium at a start of cutting, said cutter blade being substantially free of high frequency longitudinal vibration during cutting.

6. The recording medium cutting device according to claim 5, wherein the acute angle ranges from 25° to 65°.

7. The recording medium cutting device according to claim 5, wherein the acute angle ranges from 35° to 55°.

8. The recording medium cutting device according to claim 5, wherein the acute angle ranges from 40° to 50°.

9. The recording medium cutting device according to claim 5, wherein said cutter blade is substantially free of engagement with another surface other than the recording medium during cutting.

10. A recording medium cutting device for cutting a recording medium, equipped in an image formation apparatus for forming an image on a recording medium having been delivered to an image formation region in a delivery direction, the recording medium cutting device comprising:

a pressing member movably adapted to press against the recording medium for holding the recording medium in a position during a cutting operation, a cutter blade which cuts the recording medium by moving in a direction crossing the delivery direction of the recording medium, said cutter blade having a side face facing the delivery direction, said side face of the cutter blade facing the delivery direction at an acute angle of less than 90° with respect to the recording medium at a start of cutting.

11. The recording medium cutting device according to claim 10, wherein the acute angle ranges from 25° to 65°.

12. The recording medium cutting device according to claim 10, wherein the acute angle ranges from 35° to 55°.

13. The recording medium cutting device according to claim 10, wherein the acute angle ranges from 40° to 50°.

14. The recording medium cutting device according to claim 10, wherein said cutter blade is substantially free of engagement with another surface other than the recording medium during cutting.

15. The recording medium cutting device according to claim 10, wherein said cutter blade being substantially free of high frequency longitudinal vibration during cutting.

16. The recording medium cutting device according to claim 10, further comprising a holding member for holding the recording medium against a surface.

17. The recording medium cutting device according to claim 16, wherein said holding member comprises a suction device for holding the recording medium against the surface.

18. The recording medium cutting device according to claim 17, wherein the surface has apertures defined therein and said suction device sucks through the apertures to hold the recording medium against the surface.

* * * * *